United States Patent [19]

Price

[11] Patent Number: 4,942,328

[45] Date of Patent: Jul. 17, 1990

[54] CABINET WITH ELEVATING SHELF

[76] Inventor: Richard Price, 24529 Los Alisos #293, Laguna Hills, Calif. 92653

[21] Appl. No.: 332,236

[22] Filed: Mar. 31, 1989

[51] Int. Cl.[5] ..... A47B 57/00

[52] U.S. Cl. ..... 312/306; 312/272.5

[58] Field of Search ..... 312/290, 306, 272.5, 312/276, 272, 7.2, 312, 323, 25

[56] References Cited

U.S. PATENT DOCUMENTS

| | | | |
|---|---|---|---|
| 1,457,744 | 6/1923 | Newman et al. | 312/25 |
| 2,411,221 | 11/1946 | McGuire | 312/272.5 |
| 2,455,154 | 11/1948 | Bailey | 312/306 X |
| 2,527,407 | 10/1950 | Dunn | 312/272.5 |
| 2,812,227 | 11/1957 | Hill | 312/306 X |
| 4,338,987 | 7/1982 | Miles | 312/306 X |

*Primary Examiner*—Joseph Falk

*Attorney, Agent, or Firm*—Stetina and Brunda

[57] ABSTRACT

A cabinet for retractably storing audio/video equipment is provided. The cabinet comprises a main body and a flip-up/slide-in top door adapted to rotate from a horizontal to a vertical position, and thereafter descend vertically within the main body. A support shelf is disposed within the main body and adapted to slideably vertically traverse within the main body as the top door descends. Connecting means are provided for elevating the support shelf when the top door descends within the main body.

11 Claims, 3 Drawing Sheets

FIG. 1
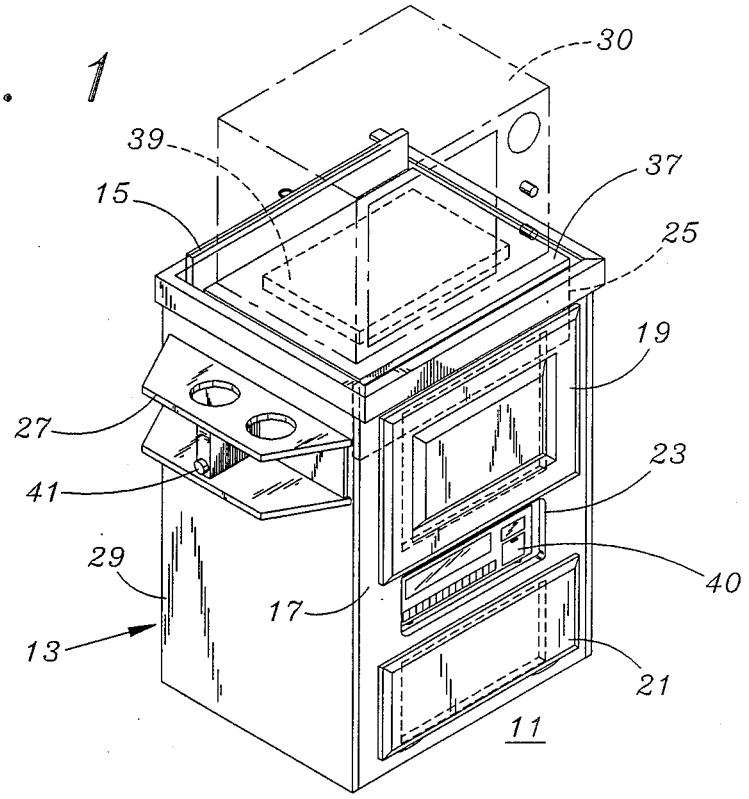
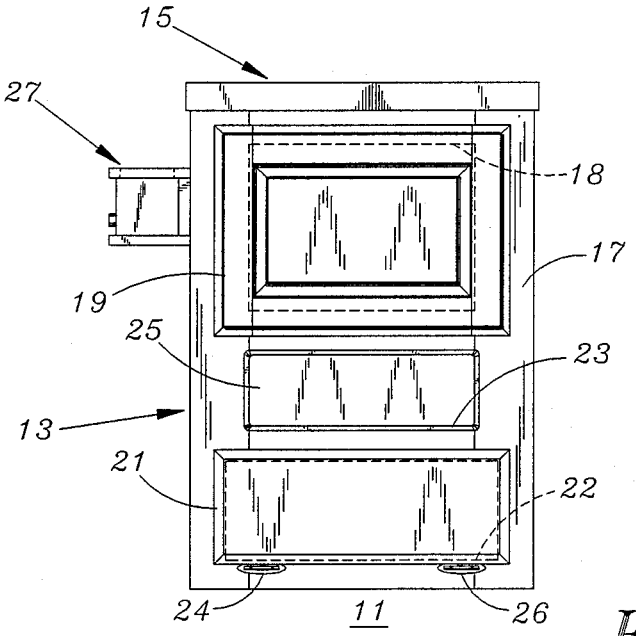
FIG. 2a

CABINET WITH ELEVATING SHELF

BACKGROUND OF THE INVENTION

The present invention relates to cabinets and, more particularly, to a cabinet having an elevating shelf for storing objects, such as a television, in a manner that such objects are stored out of sight yet easily raised to a position for use.

Various types of cabinets are well known for storing a variety of different types of objects. Cabinets are constructed to have an attractive appearance and also be functional in their storage functions. Often the two objectives conflict in that constructions that are intended to optimize functionality do so at the cost of impairing the aesthetic appearance of the cabinet. The present invention is directed to providing a construction which is intended to achieve a high degree of functionality without sacrificing appearance.

There are a number of cabinets intended to house different types of audio equipment In some cases the audio/video equipment simply sits in an open well area where it is permanently exposed to view. In other cases, the audio/video equipment is concealed by doors that open outwardly or upwardly to expose the audio/video equipment as may be necessary for use. In the case where the audio/video equipment ia stored in a well area behind doors it is frequently necessary to provide an extension mechanism in order to slide the television or other equipment to a position wherein it can ba rotated and viewed from a wider range of locations.

In addition, consumers frequently find that cabinetry that incorporates the desired functional features are not constructed in a design that is consistent with the customer's tastes and/or the design of other furniture items in the area in which the cabinet is to be located. Accordingly, the functional limitations of existing cabinets for storing audio/video equipment, and the limited design selections of suitable products serve to limit the available selection of products that satisfy the needs of many customers. The present invention is directed to providing a product which is easily modifiable in appearance to conform to the tastes of a particular customer and is highly functional for the storage of audio/video equipment. Moreover, the present invention is designed to be usable not only in homes and offices, but also in vehicles, such as vans, where base limitations and functional requirements are exteremely important.

SUMMARY OF THE INVENTION

A cabinet for retractably storing audio/video equipment is provided. The cabinet comprises a main body and a flip-up/slide-in top door adapted to rotate from a horizontal to a vertical position, and thereafter descend vertically within the main body. A support shelf is disposed within the main body and adapted to slideably vertically traverse within the main body as the top door descends. Connecting means are provided for elevating the support shelf when the top door descends within the main body.

A vertical panel is secured to the support shelf and forms a first outer surface of the cabinet. As the top door descends within the main body the vertical panel is elevated with the support shelf, thereby exposing a first cavity within the main body. In the preferred embodiment a television is disposed on the support shelf and a video cassette recorder is disposed adjacent the first panel. Thus, as the top door descends within the main body the television is elevated to the top surface of the cabinet and the video cassette recorder is exposed as a consequence of movement of the vertical panel.

The preferred embodiment of the invention further includes counterweights connected to offset the weight of the television and thereby facilitating the vertical movement of the top door within the main body.

BRIEF DESCRIPTION OF THE DRAWINGS

FIG. 1 is an isometric view of the presently preferred embodiment of the invention with the audio/video equipment shown in the unstowed position;

FIG. 2*a* is a front view of the preferred embodiment of the invention in a closed position;

DETAILED DESCRIPTION OF THE PRESENTLY PREFERRED EMBODIMENT

Figure 2B:
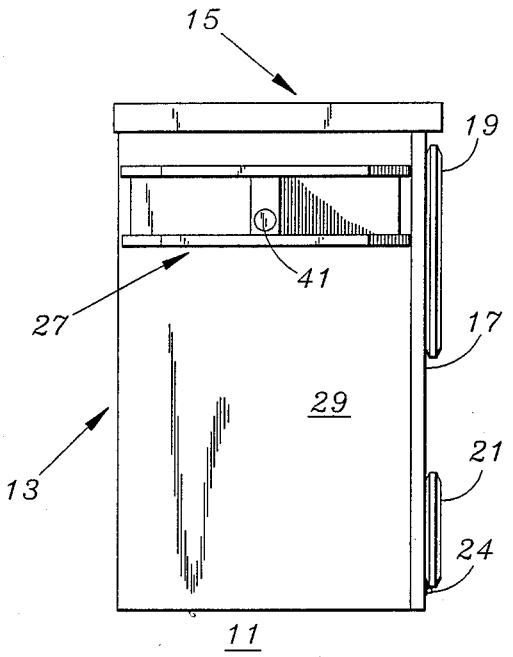
FIG. 2*b* is a first side view of the embodiment disclosed in FIG. 2*a;*
Figure 2C:
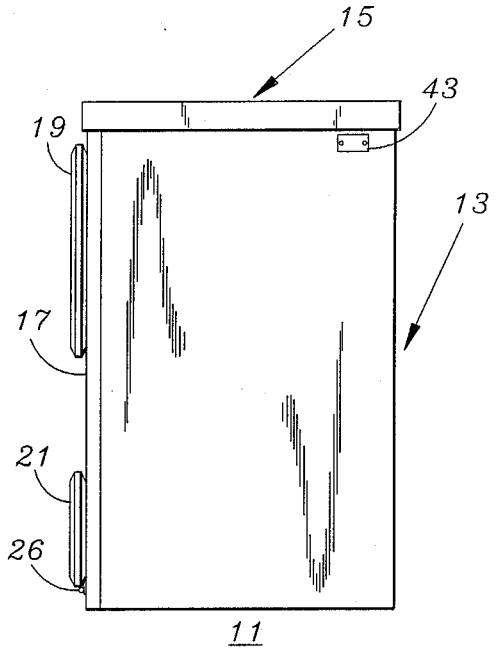
FIG. 2*c* is a second side view of the embodiment disclosed in FIG. 2*a;*
Figure 2D:
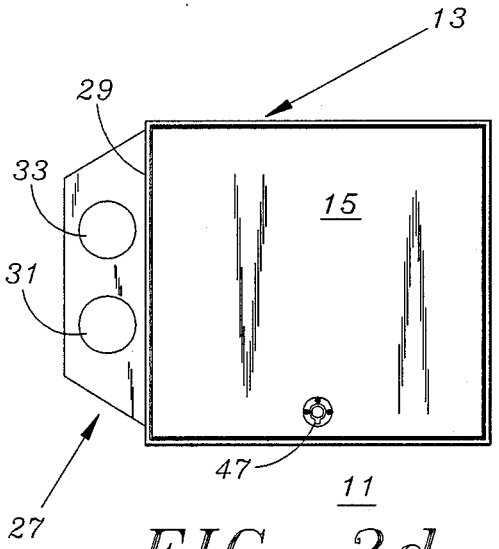
FIG. 2*d* is a top view of the embodiment disclosed in FIG. 2*a;*
Figure 3D:
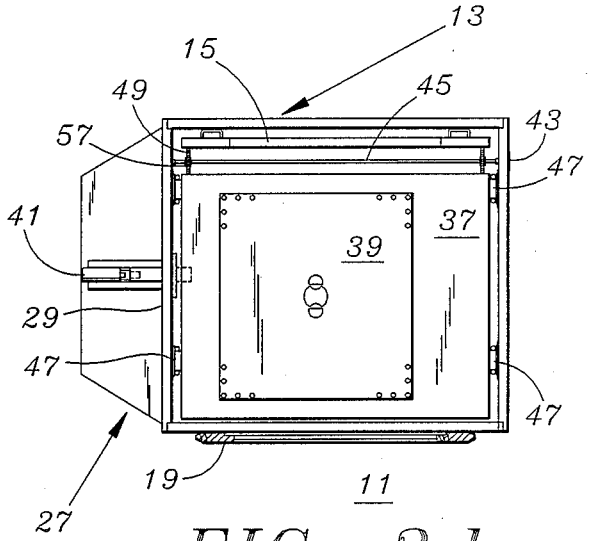
FIG. 3*d* is a top view of the presently preferred embodiment showing the top door in the open position.
Figure 3A:
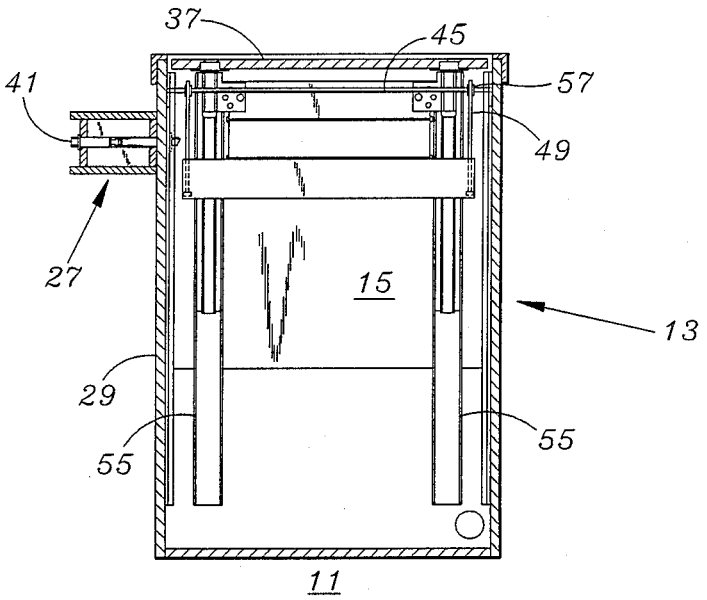
FIG. 3*a* is a front sectional view of the presently preferred embodiment showing the sliding support shelf in the uppermost position.
Figure 3B:
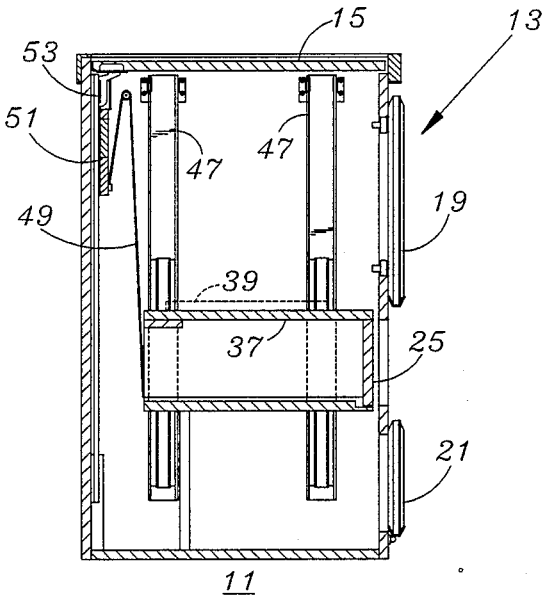
FIG. 3*b* is a side sectional view of the presently preferred embodiment showing the sliding support shelf in the lowermost position.
Figure 3C:
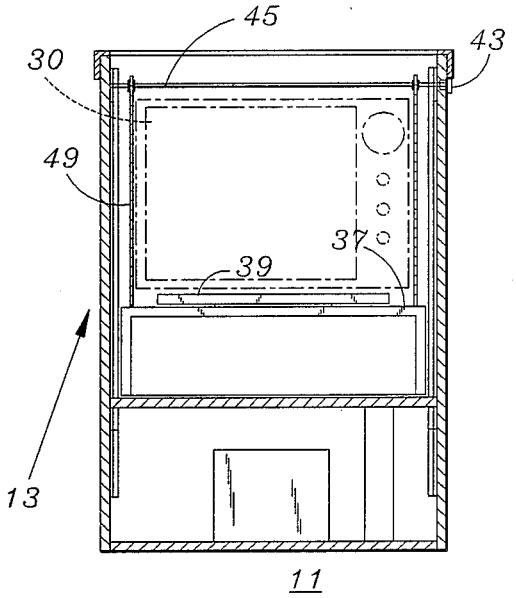
FIG. 3*c* is a second front sectional view of the invention showing the support shelf in the lowermost position.

The detailed description set forth below is intended merely as a description of the presently preferred embodiment of the invention, and is not intended to represeent the only form in which the present invention may be constructed or utilized. The description below sets forth the functions and sequence of operation affected in connection with use of the illustrated embodiment. It is to be understood, however, that the same, or equivalent functions or operations may be accomplished by different embodiments that are also intended to be encompassed within the spirit and scope of the invention.

FIG. 1 of the drawings illustrates a perspective view of the presently preferred embodiment of the invention. As shown at FIG. 1 the cabinet 11 includes a main body 13 and a flip up/slide in top door 15. The main body 13 includes a front portion 17 formed to support an upper panel 19 and a lower panel 21. The front portion 17 also includes a recess 23, behind which is disposed retractable panel 25.

The presently preferred embodiment is also formed to include beverage holder 27 secured to the side portion 29 of main body 13. The beverage holder 27 is typically formed to include a plurality of container receiving apertures for holding beverages. It is to be understood that for certain uses it may not be desirable to incorporate beverage holder 37 in the construction of cabinet 11. For example, where cabinet 11 is disposed in a bedroom the incorporation of beverage holder 27 may not be deemed suitable. However, for other uses, such as where the cabinet 11 is disposed in a vehicle, it may be very desirable to incorporate features such as beverage holder 27.

The cabinet 11 is formed to include a shelf 37 adapted to vertically traverse within body 11. The shelf 37 is formed to support equipment, such as a television in such a manner as to permit the television 30 to be retracted within body 13 of cabinet 11. Alternatively, the shelf 11 may be elevated to a position substantially even with the upper surface of the body 13 to permit viewing of the television 30. The television 30 may be mounted on a swivel plate 39 secured to shelf 37 to facilitate rotation of the television to permit viewing from different directions. It is noteworthy that when the shelf 27 is in the elevated, or unstowed postion there are no side members to hinder viewing of the television from different angles. Consequently, the present invention provides an advantageous construction that permits a wide range of television viewing angles without suffering appearance penalties when the television is not in use.

Vertical panel 25 is preferably attached to shelf 37 such that as shelf 37 is elevated the vertical panel 25 such that as the shelf 37 the vertical panel 25 is displaced from recess 23 exposing and allowing access to video cassette recorder 40, or similar equipment. As the shelf 37 is restored to the stowed position vertical panel 25 is returned to its original position adjacent recess 23. As described more fully below the shelf 37 is elevated to the unstowed position as a result of the movement of flip top/slide in door 15. The shelf 37 is returned to the lower, stowed position by depression of release mechanism 41, which allows the shelf 37 and the television 30 to return to the lower stowed position. As is also more fully described below, the mechanism within cabinet 11 includes counterweights which are useful to regulate the motion of shelf 37 so that, upon depression of the lock release mechanism 41 the shelf 37 slowly drops into the stowed position.

FIGS. *2a*, *2b*, *2c* and *2d* illustrate the construction of the exterior of the cabinet 11 from different views. FIG. *2a* illustrates a front view of the cabinet 11. As shown therein the cabinet 11 is formed to include an upper panel 19, a retractable intermediate panel 25 and a lower rotatable panel 21. The upper panel 19 is formed to snap-fit into recess 18, by means of various types of snap fasteners. (See also FIG. *3b*) Thus, the panel 19 may be removed and replaced with another panel of similar size but of different style. Accordingly, the visual styling of the cabinet 11 may be modified by simply replacing one type panel with another.

The removability of panel 19 also permits easy access to the interior of cabinet 11 as may be desired.

Lower panel 21 is formed to cover aperture 22, formed in the main body 13. The lower panel 21 may be rotated downwardly about hinges 24, 26 to expose a lower storage area within main body 13. The lower storage area may be used to store video cassettes or other items as desired. As with upper panel 19, the lower panel 21 may be replaced with a panel of different styling without the need to modify any of the structural aspects of cabinet 11. Additionally, it is anticipated that, where reduced height is desirable, the height of main body 13 may be reduced by eliminating the portion corresponding to lower panel 21. For example, where it is desired to use the cabinet 11 in a mini van, it may be useful to use a smaller version, which does not incorporate a lower compartment. The remaining portion of cabinet 11 may be retained.

FIGS. *2b*, *2c* and *2d* provide further illustration of the construction illustrated at FIGS. 1 and *2a*. FIG. *2c* further illustrates the bracket support 43 which keep the rod from being able to slide out of the cabinet illustrated at FIGS. *3c* and *3d*. FIG. *2d* further illustrates retractable ring mechanism 47 used to elevate the flip top/slide in door 15 to the vertical position.

FIGS. *3a*, *3b*, *3c* and *3d* provide sectional views of the cabinet 11 showing various aspects of the internal construction and mechanism for elevating and lowering the sliding shelf 37 and vertical panel 25. FIG. *3a* is a front sectional view of the cabinet 11 illustrating the shelf 37 in the upper or unstowed position. As further shown in FIGS. *3b*, *3c* and *3d*, the shelf 37 is a plurality of slides 47 to permit shelf 37 to vertically traverse within main body 13. The slides 47 may be any of number of commercially available mechanisms, such as the medium duty utility slide Model C-214 marketed by Accuride. The shelf 37 is also connected to a first end of steel roller chain 49. The second end of steel roller chain 49 is secured to counterweights 51 which, along with top door 15 vertically traverse main body 13 in the opposite direction of shelf 37. Top door 15 is pivotal about hinge mechanism 53 to rotate from a horizonal position to a vertical position. The hinge mechanism 53 is in turn engageable with one or more slides 55. When the top door 15 is rotated to a vertical orientation the top door 15 may therefore be depressed downwardly as the hinge mechanism 53 rides along slides 55. The depression of top door 15 downwardly causes the chain 49 to engage chain sprocket 57, which rotates about steel rod 45. The sliding shelf 37, attached to the other end of chain 49 is therefore urged upwardly until the shelf 37 is elevated to the uppermost position. At that point the latch mechanism 41 engages the recess formed in or attached to the side wall to hold the top door in the depressed position, and thereby hold the shelf 37 in the elevated or unstowed position.

In the presently preferred embodiment counterweights 51 are formed as three one-half inch thick metal plates welded together. The weight of the counterweights 51 is preferrably selected to be slightly less than the weight of the shelf 37 and supporting television 40. Consequently, when the latch mechanism 41 is released the television will slowly descend into the main body of cabinet 11 without effort by the user. However, the counterweights are sufficiently close to the weight of the shelf 37 in combination with television 30 that little effort is required to depress the top door 15 into the main body 13. Prototypes have established that a small child can easily depress top door 15 into the main body 13 when a television is disposed on shelf 37.

In the presently preferred embodiment steel chain 49 is formed as a #25 steel roller chain such as sold by Milano Imports and slides 55, as with slides 47, may be implemented as a medium duty utility slide Model C214 by Accuride. Sprocket 57 may be implemented as a Browning Roller Chain Sprocket, Part #25B10. The swivel 39 may be implemented as a number of any commercially available swivels, such as the plastic T.V. base marketed by O.W. Donald Co.

Release mechanism 41 may be implemented using a spring latch such as that marketed by Weslok, 2¾ inches.

Upper panel 19 may be secured to main body 13 by any of a plurality of catch mechansims, such as the plastic post and catch, Part #JB3701 sold by Louis and Company.

It is to be understood that various other types of support and slide or other elevational mechanisms may be substituted without departing from the broader aspects of the present invention. For example, it is anticipated that a motor may be installed in or adjacent cabinet 11 in order to electrically elevate and retract the shelf 37 within main body 13. It is further to be understood that the cabinet 11 may be sized or shaped in various ways to suit the particular decor requirements without departing from the broader aspects of the invention.

What is claimed is:

1. A cabinet for retractably storing audio/video equipment comprising:

a main body;

a flip up/slide in top door adapted to rotate from a horizontal to a vertical position and thereafter descend vertically within the main body;

a support shelf disposed within the main body and adapted to slideably vertically traverse within the main body; and connecting means for elevating the support shelf when the top door vertically descends within the main body.

2. The cabinet as recited in claim 1 further comprising:

a vertical panel secured to said support shelf, said vertical panel forming a first outer surface of the cabinet until the top door descends within the main body, said vertical panel being elevated with said support shelf to expose a first cavity, within said main body.

3. The cabinet as recited in claim 2 wherein said vertical panel is rigidly secured to a first edge portion of said support shelf.

4. The cabinet as recited in claim 2 wherein said first support shelf is sized to receive and support a television and said first cavity is sized to receive a video cassette recorder.

5. The cabinet as recited in claim 1 further comprising a second vertical panel forming a second outer surface of the cabinet, said second vertical panel being retractably engageable to said main body.

6. The cabinet as recited in claim 1 wherein said support shelf traverses between a first position within said main body and a second position substantially flush with the main body upper surface.

7. The cabinet as recited in claim 6 further comprising a release mechanism operative to hold the support shelf in said second position, said release mechanism being further operative, when depressed, to permit the support shelf to return to said first position and to move said top door upwardly in a vertical plane.

8. The cabinet as recited in claim 1 wherein said connecting means comprises:

a first track disposed within said main body for receiving said top door as said top door descends within said main body;

a second track slideably engaging the support shelf for guiding vertical movement of the support shelf disposed within said main body;

linkage for translating the vertical movement of the top door to opposite vertical movement of the support shelf; and counterweights connected to said linkage for offsetting the weight of an object supported by the support shelf and thereby facilitate vertical movement of the top door within the main body.

9. The cabinet as recited in claim 8 wherein said first track is vertically disposed within said main body.

10. The cabinet as recited in claim 1 wherein said top door includes a first edge portion, said top door being adapted to rotate about a horizontal axis substantially defined by said first edge portion.

11. The cabinet as recited in claim 1 wherein, after rotation to a vertical position, said top door moves in a vertical plane within the main body.

* * * * *